US007460801B2

(12) United States Patent
Nishiyama

(10) Patent No.: US 7,460,801 B2
(45) Date of Patent: Dec. 2, 2008

(54) IMAGE FORMING APPARATUS WITH CONTROL OF POWER DISTRIBUTION TO HEAT FIXING DEVICE

(75) Inventor: Kazushige Nishiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 11/414,185

(22) Filed: May 1, 2006

(65) Prior Publication Data

US 2006/0250634 A1 Nov. 9, 2006

(30) Foreign Application Priority Data

May 9, 2005 (JP) ..... 2005-136281

(51) Int. Cl.
*G03G 15/20* (2006.01)

(52) U.S. Cl. ..... 399/44; 399/70; 399/96

(58) Field of Classification Search ..... 399/44, 399/70, 88, 96, 69; 219/216
See application file for complete search history.

(56) References Cited

U.S. PATENT DOCUMENTS 4,585,319 A * 4/1986 Okamoto et al. ..... 399/96
4,720,727 A * 1/1988 Yoshida ..... 399/93
4,920,252 A * 4/1990 Yoshino ..... 219/497
5,043,595 A * 8/1991 Sugiyama ..... 307/39
2006/0245790 A1* 11/2006 Hamakawa et al. ..... 399/236

FOREIGN PATENT DOCUMENTS

JP 06332271 A * 12/1994
JP 08095447 A * 4/1996
JP 09204115 A * 8/1997
JP 10-282821 10/1998
JP 2002040887 A * 2/2002
JP 2003084621 A * 3/2003
JP 2004234996 A * 8/2004

* cited by examiner

*Primary Examiner*—Robert Beatty
(74) *Attorney, Agent, or Firm*—Fitzpatrick Cella Harper & Scinto

(57) ABSTRACT

An image forming apparatus for forming an image by a power supply from a commercial power source, the image forming apparatus including: an image forming member for forming an image on a recording material; a heater for heating the image forming member; a heat fixing device for fixing an image formed on the recording material; a capacitor for storing power supplied from the commercial power source; and a distributor for distributing power stored in the capacitor to the heat fixing device and the heater.

3 Claims, 7 Drawing Sheets

IMAGE FORMING APPARATUS WITH CONTROL OF POWER DISTRIBUTION TO HEAT FIXING DEVICE

BACKGROUND OF THE INVENTION

1. Field of the Invention

The present invention relates to an image forming apparatus such as a copying machine, a printer, and a facsimile, which employs an electrophotographic printing process or the like.

2. Related Background Art

Up to now, for example, in an image forming apparatus for forming a monochromatic image or a color image by employing an electrophotographic printing method, an unfixed toner image is formed on a recording material by employing a transfer method or a direct method. In the image forming apparatus, the toner image is fixed onto the recording material by heat and pressure to obtain a permanent fixed image. As a fixing means currently mostly adopted, there is given a fixing device which employs a heating roller method in view of high speed, safety, and the like.

The heating roller method is a method in which a fixing roller heated by a heating member such as a halogen heater and a pressure roller provided so as to oppose to the fixing roller are brought into pressure contact with each other to form a mutual press-contacting portion called a nip portion, and the recording material bearing the unfixed toner image is allowed to pass between both the rollers to be heated.

The fixing roller made of a metal such as iron or aluminum is mainly used, so a heat capacity thereof is large. Accordingly, for example, a long ramp-up period from a few minutes to ten and several minutes is required to raise the temperature of the fixing roller up to around 190° C., which is an applicable temperature.

In an apparatus such as a copying machine, power is supplied to the fixing roller and the temperature thereof is maintained to a preheating temperature, which is a little lower than the applicable temperature even at a stand-by time where a user does not perform printing. When printing is performed, the fixing roller is immediately heated up to the applicable temperature, thereby being capable of reducing waiting time of the user until the temperature of the fixing roller rises.

In recent years, a growing awareness of environmental conservation has led to establishment of regulations in view of energy saving in a plurality of countries. It is preferable that a power supply is reduced to zero when apparatuses are not used, since it is effective in power saving to reduce an energy consumption during a stand-by time which accounts for a large part of power consumption.

When standby power is reduced to zero in a conventional structure, it takes a long time to heat up the fixing roller when the fixing roller is used again, thereby making it less convenient for the user. Therefore, there is required a structure with which the temperature of the fixing roller can immediately be raised.

In order to shorten the temperature rising time of the fixing roller, it is preferable to increase input energy per unit of time, that is, normal rated power. For example, in an apparatus capable of printing with high speed, power supply voltage is set to 200 V. However, in common offices in Japan, power of 100 V-15 A is commonly used, and an upper limit of the power is 1,500 W. Thus, an extra building construction work relating to the power is required for an installation location in order to correspond to the power of 200 V. Such the solution is not general.

An image forming apparatus described in JP 10-282821 A is provided with an auxiliary power supply as a power supply for operating fixing means in addition to a main power supply. In particular, JP 10-282821 A discloses use of a secondary cell as an electrifiable auxiliary power supply. To be specific, in such the apparatus, the secondary cell is charged during a standby state of the apparatus, and the secondary cell is used in addition to the main power supply at a warming-up time of the apparatus, thereby making it possible to supply a large amount of power. A representative example of the secondary cell is a lead acid battery.

However, since a conventional image forming apparatus including an auxiliary power supply supplies power only to a fixing device, effective utilization of power of the auxiliary power supply has been insufficient.

SUMMARY OF THE INVENTION

The present invention therefore has an object to provide an image forming apparatus capable of effectively utilizing power of a capacitor.

Another object of the present invention is to provide an image forming apparatus capable of preventing an image formed on a photosensitive member from being a defective image while shortening a warming-up time of a heat fixing device by utilizing power of a capacitor.

Still another object of the present invention is to provide an image forming apparatus for forming an image by a power supply from a commercial power source, the image forming apparatus including: an image forming member involved in forming an image on a recording material; a heater, which heats the image forming member; a heat fixing device, which fixes an image formed on the recording material; a capacitor, which stores power supplied from the commercial power source; and a distributor, which distributes power stored in the capacitor to the heat fixing device and the heater.

Further another object of the present invention will be made clear described in the following detailed description with reference to the attached drawings.

DESCRIPTION OF THE PREFERRED EMBODIMENTS

Figure 1:
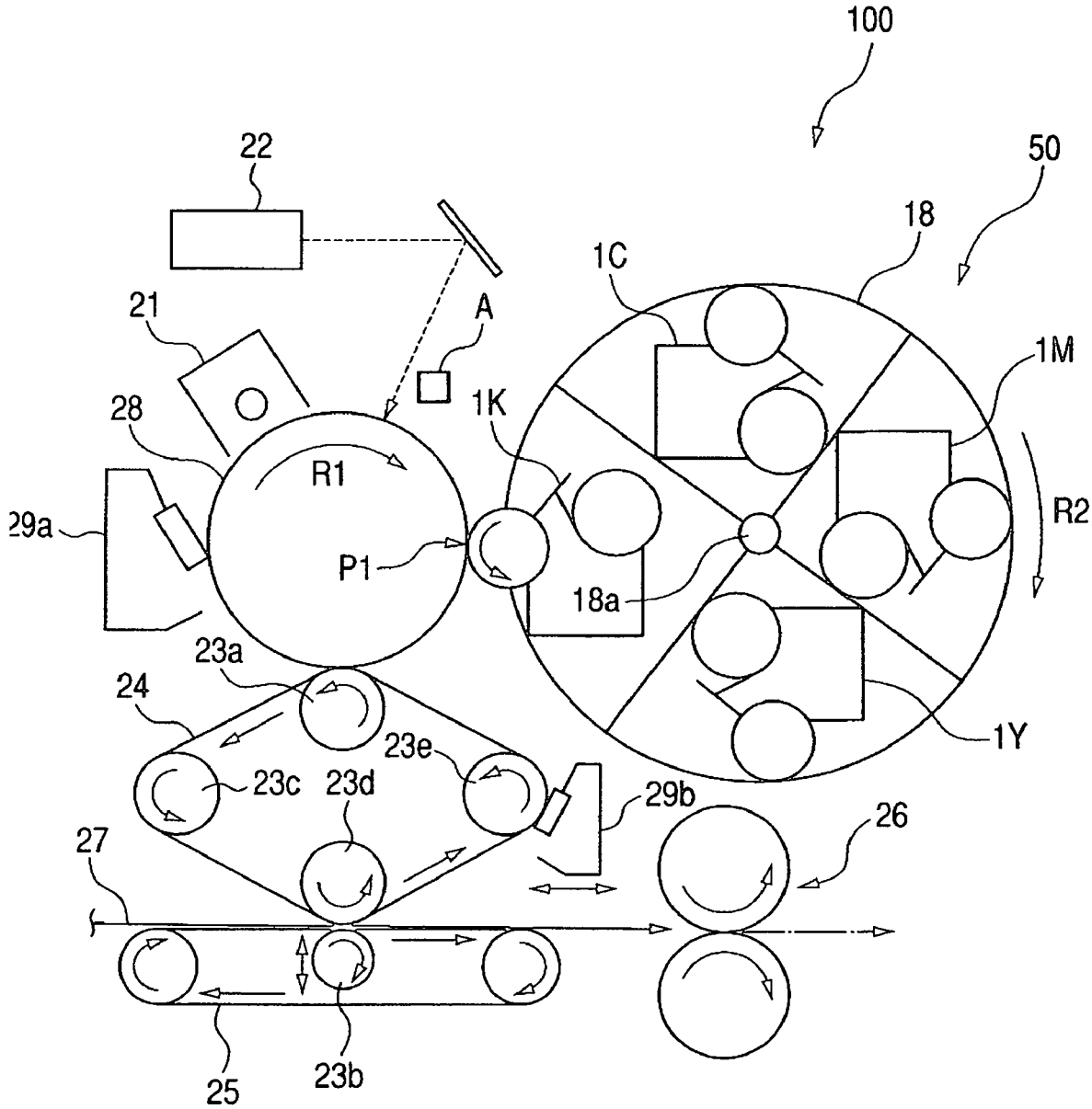
FIG. 1 is a structural diagram schematically showing an image forming apparatus according to a first embodiment of the present invention.

First Embodiment (1) Overall Construction of an Example of an Image Forming Apparatus FIG. 1 is a structural diagram schematically showing an image forming apparatus 100 according to this embodiment. The image forming apparatus includes an electrophotographic full-color copying machine or a printer, which is a one-drum system and rotary developing type, which produces 50 monochromatic copies per minute and 12 color copies per minute.

Reference numeral 28 denotes an electrophotographic photosensitive member of a drum type (hereinafter referred to as "photosensitive drum") as an image bearing member. As such the photosensitive drum 28, an amorphous silicon (a-Si) drum, which is high in durability, is used. The photosensitive drum 28 is rotated at a predetermined speed in a clockwise direction indicated by the arrow R1. Reference numeral 21 denotes a primary charger for uniformly charging the photosensitive drum 28. Reference numeral 22 denotes exposure means for exposing a surface of the charged photosensitive drum 28 according to image information to form an electrostatic latent image on the surface of the photosensitive drum 28. Reference numeral 50 denotes a rotary developing apparatus for developing the electrostatic latent image formed on the photosensitive drum 28 into a toner image by using a developing apparatuses 1K, 1Y, 1M, and 1C for developing a plurality of colors. Reference numeral 23*a* denotes a first transfer charger (transfer charging roller) for transferring the toner image formed on the photosensitive drum 28 onto an intermediate transferring belt 24 as an intermediate transfer member. Reference numeral 29*a* denotes a first cleaner for removing residual toner or the like remained on the surface of the photosensitive drum 28 after the toner image is transferred.

The intermediate transferring belt 24 is stretched around four supporting rollers including the supporting roller 23*a* serving as the first transfer charger and supporting rollers 23*c*, 23*d*, and 23*e*. The intermediate transferring belt 24 is rotated in a forward direction of rotation of the photosensitive drum at the same speed as that of the photosensitive drum 28.

In the rotary developing apparatus 50, a rotary member 18, serving as developing apparatus holding means, supports a developing apparatus for black 1K, a developing apparatus for yellow 1Y, a developing apparatus for Magenta 1M, and a developing apparatus for Cyan 1C. A rotation axis 18*a* of the rotary member 18 can be freely rotated by driving means (not shown) such as a motor and a gear mechanism. For example, in forming a black toner image on the photosensitive drum 28, development is performed by the developing apparatus for black 1K at a developing position P1 which is placed adjacent to the photosensitive drum 28. In forming a yellow toner image on the photosensitive drum 28, development is performed at the developing position P1 to which the developing apparatus for yellow 1Y is moved by rotating the rotary member 18 about 90° in a clockwise direction indicated by the arrow R2. Similarly, in forming Magenta and Cyan toner images, development is performed at the developing position P1 to which each of the developing apparatuses for Magenta 1M and the developing apparatus for Cyan 1C is moved by further rotating the rotary member 18 about 90° in a clockwise direction indicated by the arrow R2.

Developing containers for each of the developing apparatuses 1K, 1Y, 1M, and 1C for developing a plurality of colors contain two-component developer (developer) which mainly contains non-magnetic toner (toner) and magnetic toner (carrier). In this embodiment, the toner density of the developer in an initial state is about 8% by weight. The toner contains a binder resin, a colorant, a color resin particle, which can contain other additives if necessary, and a color particle, which is added with an extraneous additive such as a colloidal silica powder. In addition, the toner is made of a polyester resin of a negative charge type which is manufactured by a polymerization method, and preferably has a volume mean particle diameter of 5 μm or larger and 8 μm or smaller. In this embodiment, the volume mean particle diameter is 7.2 μm. Iron with an oxidized or unoxidized surface, nickel, cobalt, manganese, chrome, metal such as rare earth and an alloy of these metals, or oxide ferrite, for example, can be suitably used as a carrier. The manufacturing method of these magnetic particles are not particularly limited. The weight mean particle diameter of the carrier is 20 μm to 50 μm, and is preferably 30 μm to 40 μm. Resistivity of the carrier is equal to or larger than 107 Ωcm, and is preferably equal to or larger than 108 Ωcm. In this embodiment, a carrier having resistivity of 108 Ωcm is used. Further, as a low density magnetic carrier, a resin magnetic carrier can be used which is manufactured by the polymerization method by mixing magnetic metallic oxide and non-magnetic metallic oxide into a phenolic binder resin at a predetermined ratio. For example, the volume mean particle diameter of the carrier is 35 μm, a true density of the carrier is 3.6 to 3.7 g/cm$^3$ and the magnetization amount is 53 A·m$^2$/kg.

Hereinafter, for example, the developing apparatus for black 1K, the developing apparatus for yellow 1Y, the developing apparatus for Magenta 1M, and the developing apparatus for Cyan 1C are generically mentioned simply as developing apparatus 1. In a case where there is no need to discriminate the developing apparatuses for each color, suffix letters K, Y, M, and C, which are given to indicate an element belonging to the developing apparatus for each color, are omitted.

A surface of the photosensitive drum 28, which rotates in a clockwise direction indicated by the arrow R1 is uniformly charged with a predetermined polarity and potential by the primary charger 21. In this embodiment, the surface of the photosensitive drum 28 is charged with the negative polarity. The exposure means 22 exposes the charged surface of the photosensitive drum 28 by irradiating with a laser beam or the like according to the image information, to thereby form an electrostatic latent image on the photosensitive drum 28. The electrostatic latent image is reversely developed by the developing apparatus 1 which contains desired toner, to thereby form a toner image on the photosensitive drum 28. The toner image is transferred onto the intermediate transferring belt 24 by a first transferring bias of the first transfer charger 23*a*.

In forming a full-color image, a black toner image is first formed on the photosensitive drum 28 by the developing apparatus for black 1K at the developing position P1 to primarily transfer the black toner image onto the intermediate transferring belt 24. Transfer residual toner remaining on the photosensitive drum 28 after the primary transfer is removed by the first cleaner 29*a*. Then, the developing apparatus for yellow 1Y is moved to the developing position P1 by rotating the rotating member 18 by 90° in a direction indicated by the arrow R2, to thereby form a yellow toner image on the photosensitive drum 28. The yellow toner image is primarily transferred onto the black toner image formed on the intermediate transferring belt 24 to be superimposed thereon. The operation is sequentially performed for each of the developing apparatus for Magenta 1M and the developing apparatus for Cyan 1C, to thereby form an unfixed full-color toner image which is formed by superimposing the black toner image, the yellow toner image, the Magenta toner image, and the Cyan toner image on the intermediate transferring belt 24.

On the other hand, in synchronization with the formation of the unfixed full-color toner image on the intermediate transferring belt 24, a recording material 27 such as a recording sheet and an OHP sheet is fed from recording material supply means (not shown) which includes a cassette for containing a recording material, a pickup roller, a conveying roller, and a conveying guide. The recording material 27 is supplied to a recording material conveying belt 25 which is a recording material conveying means, and then is conveyed to an opposite portion in which the intermediate transferring belt 24 is opposite to a second transfer charger 23*b* which is a second transfer means. After that, a full-color image formed on the intermediate transferring belt 24 is secondarily transferred collectively onto the recording material 27, which is placed on the recording material conveying belt 25, by a second transferring bias of the second transfer charger 23*b*.

Subsequently, the recording material 27 is separated from the recording material conveying belt 25, and is pressurized/heated by the heat fixing device 26. Thus, an unfixed full-color toner image transferred onto the recording material 27 is melted to mix the colors thereof, thereby fixing a full-color image on the recording material 27 to obtain a permanent image.

Transfer residual toner remaining on the intermediate transferring belt 24 after the secondary transfer is removed by a second cleaner 29*b* for preparation of a next image formation.

It should be noted that the recording material conveying belt 25, the second transfer charger 23*b*, and the second cleaner 29*b* are held to be separated from the surface of the intermediate transferring belt while the toner is primarily transferred onto the intermediate transferring belt 24 from the photosensitive drum 28.

In forming a monochromatic image, a black toner image is formed on the photosensitive drum 28 by the developing apparatus for black 1K at the developing position P1 to primarily transfer the toner image on the intermediate transferring belt 24. Then, the black toner image formed on the intermediate transferring belt 24 is secondarily transferred onto the recording material 27 which is conveyed by the recording material conveying belt 25. Sequentially, the recording material 27 is separated from the recording material conveying belt 25 and is pressurized/heated by the fixing device 26, thereby fixing an unfixed black toner image on the recording material 27 as a monochromatic image to obtain a permanent image.

(2) Photosensitive Drum 28 and Drum Heater

Figure 2:
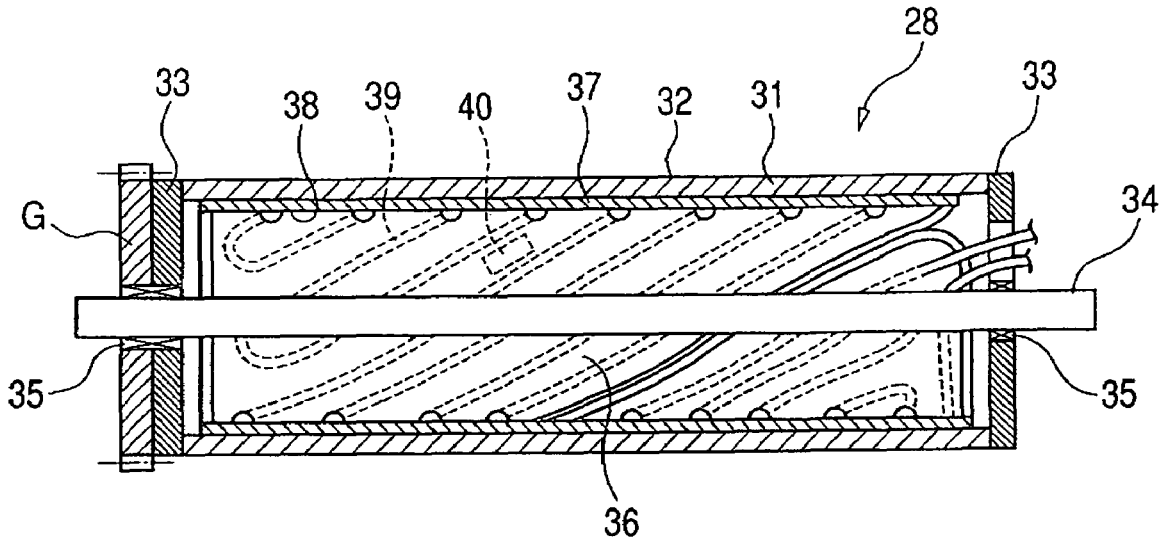
FIG. 2 is a schematic longitudinal-sectional view of a photosensitive drum.

FIG. 2 is a schematic longitudinal-sectional view of the photosensitive drum 28 serving as an image forming member involved in formation of an image on a recording material. The photosensitive drum 28 includes a photosensitive layer 32 which is formed by evaporating photosensitive material of an amorphous silicon (a-Si) onto a surface of a drum base 31 made of metal such as aluminum. Flanges 33 are mounted to both ends of the drum base 31, and a drum shaft 34 is inserted through the both flanges 33. The photosensitive drum 28 is supported via a bearing 35 about the drum shaft 34 in a rotatable manner. Reference symbol G denotes a drum gear, which is fixed to the flange 33 on one side. The photosensitive drum 28 is rotated by transmitting a driving force to the drum gear G from a drive mechanism (not shown).

Inside the drum base 31, mounted is a drum heater 36 as heating means for heating the photosensitive drum 28 in order to prevent image deletion due to high temperature and high humidity. It should be noted that the image deletion is a phenomenon in which corona products generated around the photosensitive drum is adsorbed onto the surface of the photosensitive drum through atmospheric water in an environment, so that an electric potential on a surface of the photosensitive drum does not become a desired value, and a defective image is formed.

In this embodiment, the drum heater 36 is a surface heating member attached to an inner surface of the drum base 31. To be specific, the drum heater 36 includes a substrate 37, a cotton cloth 38, and an energization heating member 39 which is arranged on one surface of the substrate 37. Both ends of two connection terminals (leads) of the energization heating member 39 are extending from the flange 33 on one side to the outside of the photosensitive drum. Reference numeral 40 denotes a sensor for sensing drum surface temperature, which is composed of a thermistor. The sensor 40 is fixed at a proper position between the substrate 37 of the drum heater 36 and the cotton cloth 38. Both ends of the two connection terminals (leads) of the sensor 40 are similarly extending from the flange 33 on one side to the outside of the photosensitive drum. One of the connection terminals of the heating member 39 and one of the connection terminals of the sensor 40 is connected to a common rotary connection portion (not shown) and the other of the terminals is electrically connected to separated rotary connection portion. Thus, the heating member 39 placed inside the photosensitive drum and the power supply are electrically connected with each other. In addition, the sensor 40, placed inside the photosensitive drum, and a controlling means are electrically connected to each other.

Figure 4:
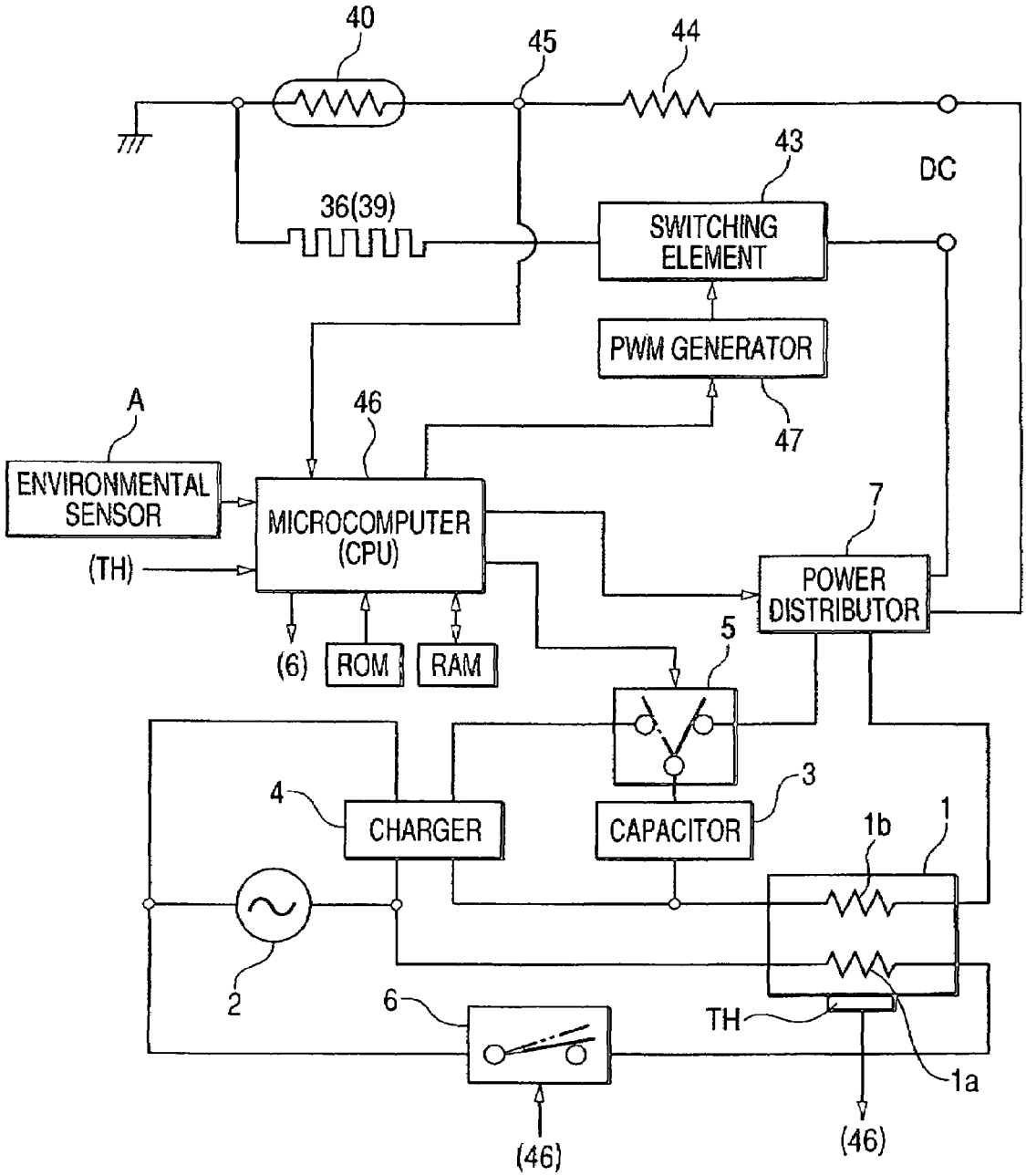
FIG. 4 is a block circuit diagram of an energization control system to the fixing device and a drum heater.

FIG. 4 shows a circuit for an energization control system between the above-described drum heater 36 and the fixing device 26 to be described below.

The drum heater 36 is supplied with power of electric storage means 3, serving as an auxiliary power supply, through a power distributor 7. A series circuit, configured by the sensor 40 and a resistance 44, is connected between terminals of the power supply. A connection point 45 between the sensor 40 and the resistance 44 is connected to an input port of a microcomputer (CPU) 46 serving as controlling means. The drum heater 36 and a switching element 43 are connected between the terminals of the power supply. ON/OFF control of the switching element 43 is performed by applying a control signal from the CPU 46 to a PWM generator (pulse width modulation) 47. The CPU 46 controls energization to the drum heater 36 from the electric storage means 3 based on a condition relating to the surface temperature of the photosensitive drum 28, thereby heating the photosensitive drum 28 up to a predetermined temperature. Wattage of the drum heater 36 used in this embodiment is 75 W.

In this embodiment, when the image forming apparatus is turned on (when a main power of the image forming apparatus is turned on), the rate of power activation from the electric storage means 3 to the drum heater 36 is changed in accordance with the detection temperature of the environmental sensor A shown in FIG. 1 serving as detecting means for detecting atmospheric environment at the time. The explanation thereof will follow in an item (4).

(3) Fixing Device 26

Figure 3:
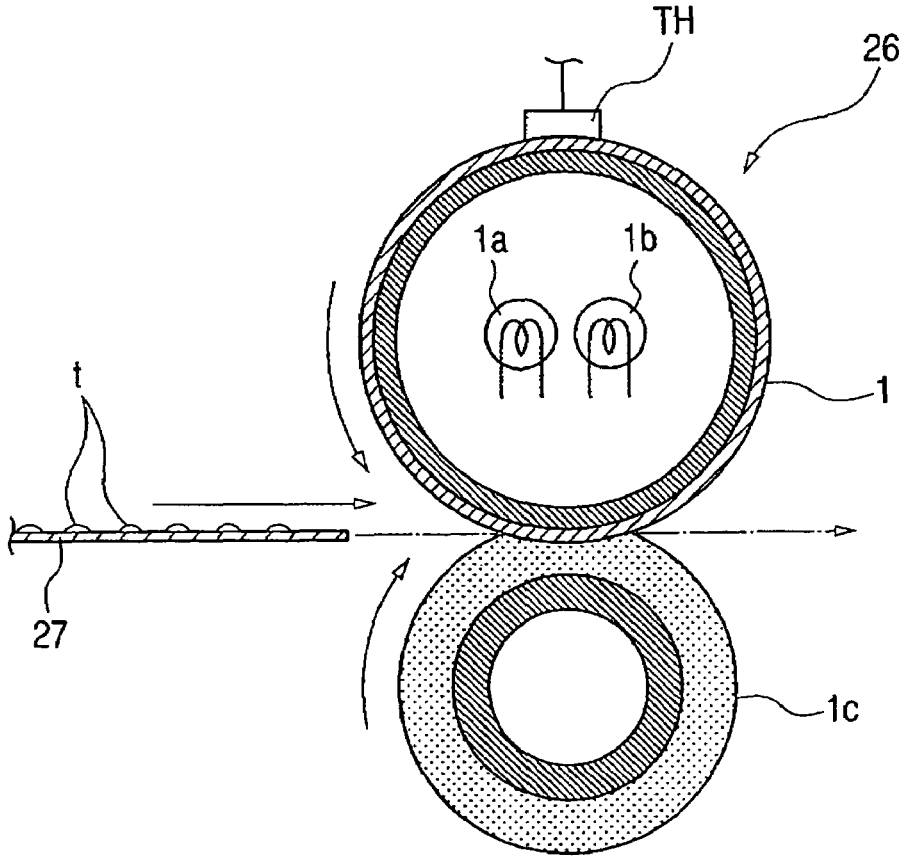
FIG. 3 is a schematic cross-sectional view of a substantial part of a heat fixing device.

FIG. 3 is a schematic cross-sectional view of a substantial part of the fixing device 26 (hereinafter referred to as "fixing device") according to this embodiment. For the fixing device 26 according to this embodiment, a heating roller method is employed. Reference numeral 1 denotes a fixing roller (heating roller) as a heating member. Reference symbol 1*c* denotes an elastic pressure roller as a pressure-contact member (pressure member). The fixing roller 1 and the pressure roller 1*c* are aligned in parallel to each other in a vertical direction, and are brought into pressure contact with each other to form a nip portion. The fixing roller 1 is constituted such that a hollow cylindrical mandrel made of iron, which has an outer diameter of 40 mm and a thickness of 1 mm, is provided with a PTFE layer having a thickness of 30 μm in order to enhance releasing ability of the surface thereof. The pressure roller 1*c* has an outer diameter of 40 mm and is provided with a silicon rubber elastic layer having a thickness of 3 mm which is provided at an outer periphery of the mandrel made of aluminum. The pressure roller 1*c* is brought into pressure contact with the fixing roller 1 by a predetermined pressing force against the elasticity of the silicon elastic layer by using a spring. Thus, a fixing nip portion having a width of about 8 mm is formed with respect to a recording material conveying direction between the pressure roller 1*c* and the fixing roller 1. The fixing roller 1 is rotated at a predetermined speed in a counterclockwise direction indicated by the arrow 1. The pressure roller 1*c* is driven to be rotated by a rotation of the fixing roller 1.

The fixing roller 1 is arranged such that a main heating member 1*a* and an auxiliary heating member 1*b* are inserted into the fixing roller 1. A halogen heater is generally used as the heating members 1*a* and 1*b*. It should be noted that the heating members 1*a* and 1*b* are not particularly limited to the halogen heater, and other resistance heating members may be used. Reference symbol TH denotes a sensor for sensing the surface temperature of the fixing roller which consists of a thermistor. The sensor is arranged to be in contact with the surface of the fixing roller 1 or is arranged to be adjacent to the surface of the fixing roller 1 and in non-contact with the surface of the fixing roller 1.

In the circuit of the energization control system shown in FIG. 4, reference numeral 2 denotes a main power supply. Power is supplied to the main heating member 1*a* of the fixing roller 1 through a switching element 6 from the main power supply (commercial power source) 2. In addition, power is supplied to the auxiliary heating member 1*b* through charge/discharge switching means 5 and the power distributor 7 from the electric storage means 3. Reference numeral 4 denotes a charger for charging the electric storage means 3.

In this embodiment, the CPU 46 is triggered by turning on the image forming apparatus to start warming up the fixing device 26. The warming-up of the fixing device 26 allows the fixing roller 1 to be rotated, and allows the switching element 6 to be turned on, thereby starting to supply power to the main heating member 1*a* from the main power supply 2. Further, the CPU 46 switches the charge/discharge switching means 5 to the discharge circuit side. Then, the CPU 46 controls the power distributor 7 to change the maximum power which can be inputted to the auxiliary heating member 1*b* from the electric storage means 3 according to the detection temperature detected by the environmental sensor A. The fixing roller 1 is heated up by the main heating member 1*a* and the auxiliary heating member 1*b*. The raised temperature of the fixing roller 1 is fed back to the CPU 46 from the sensor TH for sensing the fixing roller surface temperature. The fixing device 26 is continuously warmed up until the temperature of the fixing roller 1 is raised up to a predetermined fixing temperature. After finishing the warming-up, the charge/discharge switching means 5 is switched to a charge circuit side.

The CPU 46 controls the switching element 6 so that temperature information inputted from the sensor TH for sensing the fixing roller surface temperature is maintained at a predetermined fixed temperature, to thereby control the energization of the main heating member 1*a*. In a state where the temperature of the fixing roller 1 is controlled at a predetermined fixing temperature, the recording material 27 bearing an unfixed toner image "t" is introduced into a fixing nip portion. In a process of nipping and conveying the recording material 27 at the fixing nip portion, the unfixed toner image "t" is pressurized/heated to be fixed as a permanent image.

The main power supply 2 is a commercial power source which can be supplied from a plug socket or the like provided to an installation location for the image forming apparatus. The main power supply 2 may include a function of adjusting a voltage and a function of rectifying an alternating current and a direct current according to the main heating member 1*a*.

Power supplied to the fixing roller 1 of the fixing device 26 can be supplied to the main heating member 1*a* from the main power supply 2, and also can be supplied to the auxiliary heating member 1*b* from the electric storage means 3. Thus, the power supplied from both the main power supply 2 and the electric storage means 3 are utilized, thereby making it possible to supply a large amount of power, which is larger than the maximum power supply by the main power supply 2 for at least a predetermined period of time, to the fixing roller 1.

A capacitor is used as the electric storage means 3. In this embodiment, an electric double layer capacitor is used as a capacitor having a large capacity. Different from a secondary cell, the capacitor is not involved in a chemical reaction, so the capacitor has excellent features as described below.

1) Short Charging Time

General nickel-cadmium cell as a secondary cell requires few hours for changing even by a boost charge. On the other hand, the capacitor can be rapidly charged in about a few minutes. Therefore, since frequent charging and discharging are possible in the capacitor, it could be heated, using the auxiliary power supply, more frequently, compared to when the nickel-cadmium cell is used at a same given time.

2) Long Duration

Since the nickel-cadmium cell can be repeatedly charged and discharged only 500 to 1000 times, a duration thereof is shorter as compared with the auxiliary power supply for heating up. The labor hour for interchange and the cost come into question. On the other hand, the capacitor has an incomparable duration, and the deterioration thereof caused by repeatedly charging and discharging is less. Therefore, the capacitor is especially favorable for a power supply for heating up the fixing device of the image forming apparatus in which a non-heating operation at a stand-by time and a heating operation at an operating time are repeated. Further, there is no need to exchange or refill the liquid as in a case of a lead battery, so maintenance is barely necessary.

3) Capable of Discharging a Large Amount of Power in a Short Period of Time

Power stored in the secondary cell cannot be discharged at a burst. Thus, a large amount of power cannot be supplied when the temperature of a heating portion is raised from low temperature, providing little effect in shortening of a required time for raising the temperature. On the other hand, the capacitor can discharge a large amount of power in a few seconds, providing much effect in shortening the time for raising the temperature.

4) High Safety Even When Charge is Continued

The capacitor is not involved in a chemical reaction as in a case of a secondary cell, but is involved in a physical phenomenon. Thus, gas or the like is not generated in the capacitor, so charging is continuously performed safely. Therefore, there is no need to provide a mode of a float state.

In recent years, a capacitor, which can store a large amount of electric energy, has been developed, and adoption has been considered for an electric automobile or the like. For example, an electric double layer capacitor developed by Nippon Chemi-Con Corporation has a capacitance of about 2000 F, which is sufficient for a few seconds to a several tens of seconds of power supply. Further, a capacitor having a capacitance of about 80 F is realized in a trade name of a hyper capacitor manufactured by NEC Corporation.

When the capacitor 3 is not sufficiently charged, the CPU 46 switches the charge/discharge switching means 5 to the charge circuit side in a stand-by time or the like when power is relatively less consumed to charge the capacitor 3 through the charger 4 by the power supply from the main power supply 2. When a large amount power is required, for example, when the temperature of the fixing roller 1 is desired to be drastically raised from room temperature to operating temperature, a large amount of energy is supplied to the fixing roller 1 by utilizing the power of the capacitor 3 with the main power supply 2. Thus, the temperature of the fixing roller 1 can be raised in a short period of time. The capacitor is used as the electric storage means, thereby making it possible to obtain an effect which cannot be obtained by using a secondary cell.

As described above, in the capacitor 3, gas or the like is not generated, and charging is continuously performed safely. As a result, there is no need to provide a mode of a float state. Accordingly, the charge/discharge switching means 5 needs only to be able to switch to the charge circuit, in which the capacitor 3 is connected to the charger 4, and the discharge circuit, which is connected to the auxiliary heating member 1*b*.

In the above fixing device 26, a quantity of heat necessary for raising the temperature of the fixing roller 1 up to a predetermined fixing temperature of about 180° C. is about 12000 joule [J]. A halogen heater serving as the main heating member 1*a* which is used for the fixing roller 1 can supply power of about 800 W at a voltage of 100 V. Another halogen heater serving as the auxiliary heating member 1*b* separately from the main halogen heater 1*a* is provided in the fixing roller 1. Then, a current is caused to pass from the capacitor 3 which uses a condenser having a capacitance of 1300 F at a voltage of 2.5 V, to this auxiliary halogen heater 1*b*. Since the maximum current of the auxiliary halogen heater 1*b* is limited, when the voltage of the capacitor 3 is set to 50 V, the power of 12 A, that is, 600 W can be obtained. Thus, the power of 1200 W is supplied to the main halogen heater 1*a*, and at the same time, the power of 600 W can be supplied from the capacitor 3 to the auxiliary halogen heater 1*b*. In other words, a total power of 1400 W can be supplied to the fixing roller 1, thereby making it possible to shorten the time for warming up.

(4) Control of the Rate of Power Activation to the Capacitor

Next, a control of the rate of power activation to the capacitor by using the environmental sensor A will be described. The environmental sensor A is arranged in the vicinity of the photosensitive drum 28 which is placed inside the image forming apparatus as shown in FIG. 1. Environment detection information of the environmental sensor A is inputted to the CPU 46.

In this embodiment, the CPU 46 controls the power distributor 7 based on the temperature information obtained from the environmental sensor A to change the rate of power activation from the capacitor 3 to the fixing device 26 and the drum heater 36.

The changing of the rate is effective for fixing a side of high temperature/high humidity in an environment, but is not effective for image deletion. On the other hand, the changing of the rate is not effective for fixing a side of low temperature/low humidity in an environment, but it is effective for an image deletion. Both sides are in relation to make up for disadvantageous areas of each other.

Figure 5:
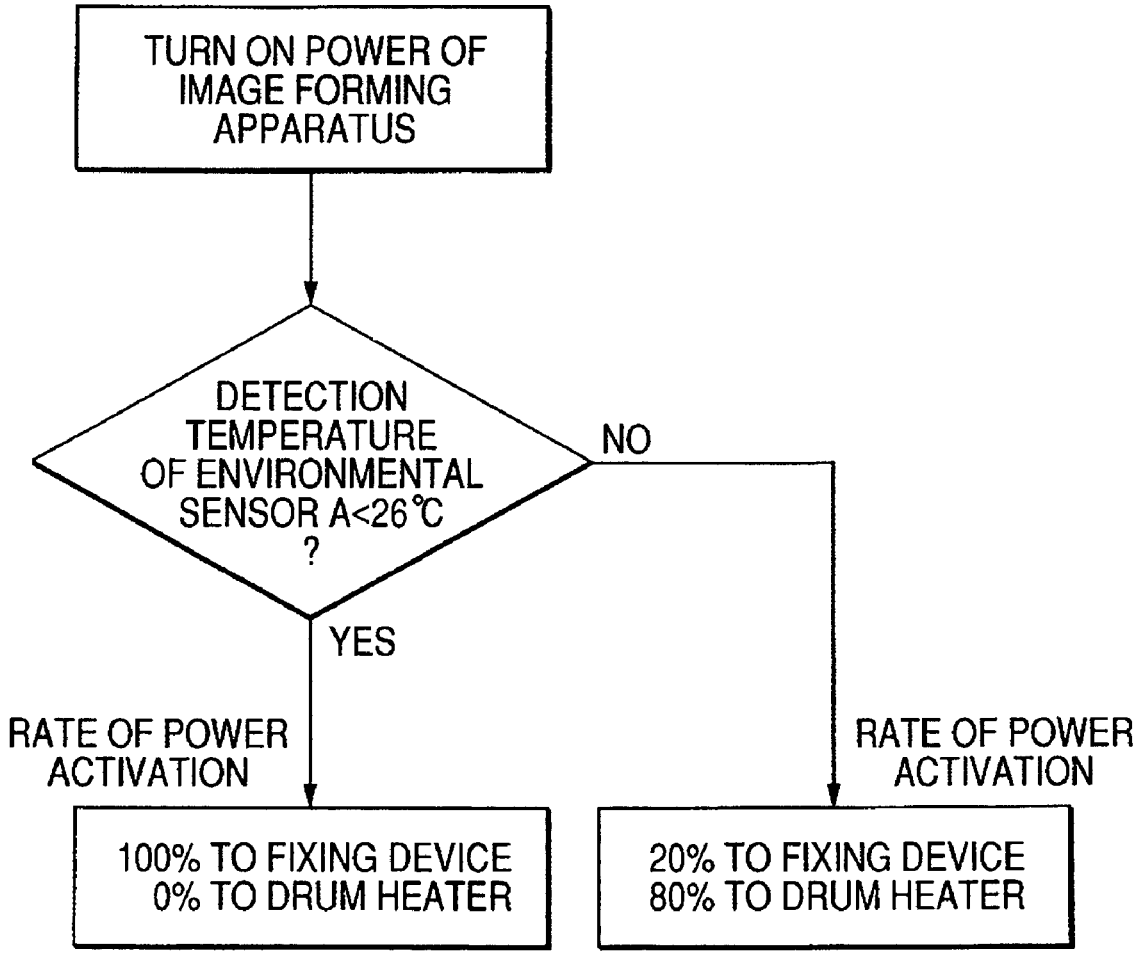
FIG. 5 is a first flowchart showing a control for changing rates of power activation of capacitor power to the fixing device and the drum heater according to the first embodiment.

In this embodiment, when the power of the image forming apparatus is turned on, the rate of power activation of the capacitor power to the fixing device 26 and the drum heater 36 is controlled to be changed based on temperature information detected by the environmental sensor A by a control flow shown in FIG. 5.

That is, when the power is turned on, when the temperature detected by the environmental sensor A is lower than 26° C., the CPU 46 judges that the humidity is also low, and controls the power distributor 7 to supply the whole (100%) power of the capacitor 3 to the fixing device 26 in order to supplement disadvantages of the fixing. Thus, the warming-up of the fixing device is assisted.

When the temperature detected by the environmental sensor A is equal to or higher than 26° C., the CPU 46 judges that the humidity is also high, and controls the power distributor 7 to supply 80% of the power of the capacitor 3 to the drum heater 36 and 20% of the power of the capacitor 3 to the fixing device 26 in order to supplement disadvantages of the image deletion of the photosensitive drum.

As a method for using the capacitor in a market, since there are many cases where a general office environment is maintained at a temperature lower than 26° C. by an air-conditioning equipment or the like, and it is considered that the capacitor is basically used to assist the fixing device 26, placing priority on the warming-up time for fixing.

Figure 6:
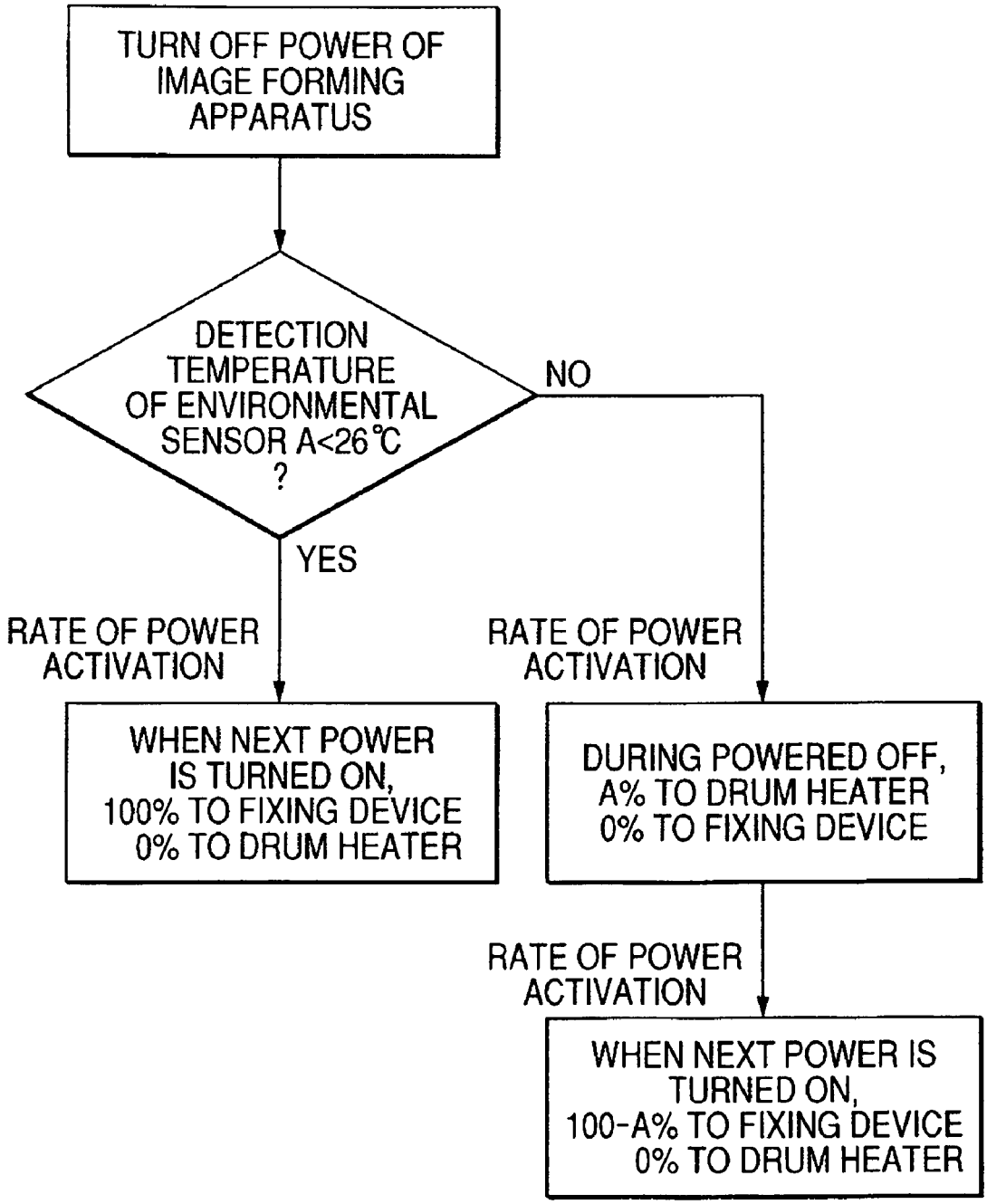
FIG. 6 is a second flowchart showing a control for changing rates of power activation of capacitor power to the fixing device and the drum heater according to the first embodiment.

FIG. 6 shows another method of controlling the rate of power activation of the capacitor power to the fixing device 26 and the drum heater 36.

a) In a Case Where the Power of the Image Forming Apparatus is Turned Off and the Temperature Detected by the Environmental Sensor A is Lower Than 26° C.

In this case, the CPU 46 controls the power distributor 7 to supply the whole (100%) power of the capacitor 3 to the fixing device 26 in order to supplement disadvantages of fixing when the power is turned on again (at first early in the morning). Thus, the warming-up of the fixing device is assisted.

b) In a Case Where the Power of the Image Forming Apparatus is Turned Off and the Temperature Detected by the Environmental Sensor A is Equal to or Higher Than 26° C.

In this case, the CPU 46 controls the power distributor 7 and uses a certain ratio A % (for example, 80%) of the capacitor power to drive (heat) the drum heater 36 during a time when the image forming apparatus is stopped (at night), and heat the photosensitive drum 28. Then, when the power is turned on again, the rest of the power (100-A)% is supplied to the fixing device 26 to assist warm-up.

In the above controlling method, it is possible to operate the drum heater for a longer period of time than at first early in the morning, therefore make it more preferable for preventing the image deletion.

Further, in this embodiment, only the temperature detected by the environmental sensor A is used, but an absolute moisture amount or a humidity (RH) detected by the environmental sensor A may be used to execute a control for changing the rate of power activation of the capacitor power to the fixing device 26 and the drum heater 36. In other words, when the absolute moisture amount or the humidity is low, the rate of the power activation to the fixing device 26 is set to be large to attach importance to the fixation, and when the absolute moisture amount or the humidity is high, the rate of the power activation to the drum heater 36 is set to be large to attach importance to the drum heater.

Further, the rate of the power activation of the capacitor power to the fixing device 26 and the drum heater 36 may be controlled to be changed based on combined information of the absolute moisture amount and the humidity.

Next, switching of the charge/discharge switching means 5 will be described. The CPU 46 switches the charge/discharge switching means 5 to the discharge circuit side which connects the capacitor 3 to the drum heater 36 and the auxiliary heating member 1*b* of the fixing device 26 when the power of the image forming apparatus is turned on. When warming-up is finished, the CPU 46 switches the charge/discharge switching means 5 to the charge circuit side which connects the capacitor 3 to the charger 4. As a result, the time required for raising the temperature of the fixing roller when the power is turned on to the temperature at which fixing is possible could be shortened by the power supply from the commercial power source as the main power supply 2 and the power supply from the capacitor 3, as compared with a case where power is supplied only from the commercial power source. In fact, the warming-up time is shortened by 30 seconds in an environment at a temperature lower than 26° C., and is shortened by 2 minutes in an environment at a temperature equal to or higher than 26° C., thereby obtaining an image forming apparatus which avoids the occurrence of image deletion.

Further, when charging and discharging of the capacitor 3 was repeatedly performed ten thousand times, deterioration of the capacitor was rare and there were no problem to be raised in practice. The capacitance of the capacitor 3 could be reduced by about 40% as compared with a combination of the drum heater and the fixing device, and the cost thereof could be also reduced.

With such the structure, power is effectively used, thereby making it possible to provide an image forming apparatus in which the cost of the capacitor 3 is suppressed, the defect of images due to the image deletion on the photosensitive drum or the like is prevented, and the warming-up time for the fixing device 26 is shortened.

When the image forming apparatus is in a standby state, for example, when the image forming apparatus stopped operating for 30 minutes, the fixing device 28 is set at a low-power mode (power saving mode) and the temperature thereof is controlled at a low preset temperature.

The control for changing the rate of power activation of the capacitor power to the fixing device 26 and the drum heater 36 can also be executed when the image forming apparatus is in a state of power-on and is returned (corresponding to when the power is turned on) from the low-power mode based on the image forming start signal in a standby state at a low-power mode (corresponding to when the power is turned off). In addition, when the image forming apparatus is returned from the standby state to a state in which image forming is possible, the control of changing the rate of the power activation to the fixing roller 26 and the drum heater 36 can also be controlled according to the stand-by time.

Second Embodiment

In this embodiment, the rate of power activation from the capacitor 3 to the fixing device 26 and the drum heater 36 is not changed or controlled based on a certain environmental temperature reference, but adopts a method of changing the rate of power activation by using the environmental table for the environmental temperature.

This is because the performance of the image deletion and the wattage required for fixing are not digital (binary) but analog, and an optimum change of the rate of the power activation can be performed by adopting the method.

In addition, in this embodiment, the CPU 46 includes counting means for counting turn-off time from when the power of the image forming apparatus is turned off. In order to distinguish it from a short-term power-off such as a jam with regard to the heating of the drum heater 36 at night, the CPU 46 counts time T which has elapsed since the power of the image forming apparatus has been turned off. The CPU 46 judges that it is night when the turn-off time is longer than a predetermined time, and operates the drum heater 36 according to a state of the environment when the power is turned on again.

Figure 7:
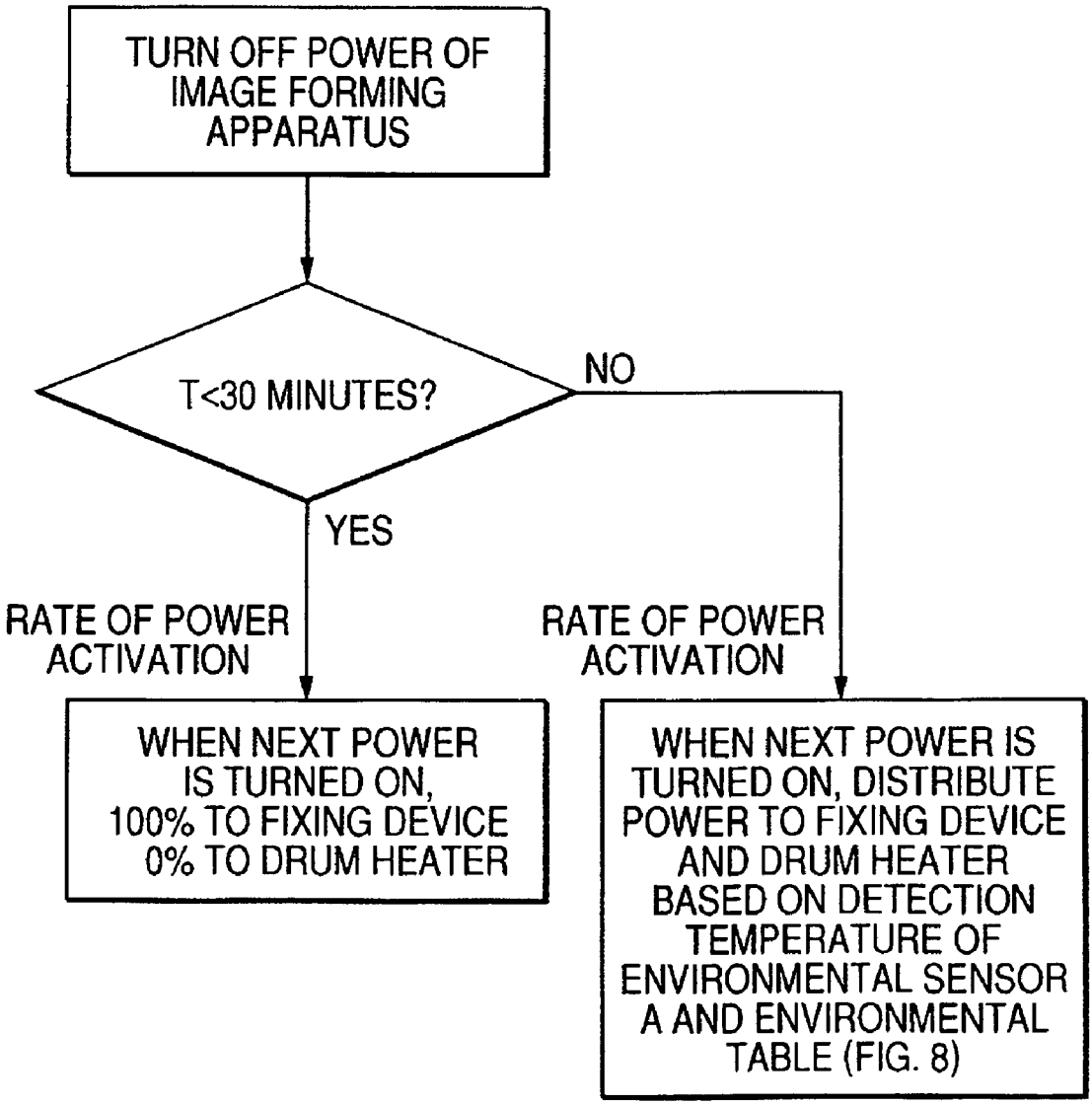
FIG. 7 is a third flowchart showing a control for changing rates of power activation of capacitor power to the fixing device and the drum heater according to a second embodiment.

The contents of this embodiment will be described with reference to the control flow chart shown in FIG. 7. An image forming apparatus according to this embodiment is similar to that of the first embodiment.

In this embodiment, the CPU 46 judges that it is night when the elapsed time T since the power is turned off is equal to or longer than 30 minutes. Then, when the power is turned on again (at first early in the morning), performed is a sequence of controlling and changing of the rate of power activation for distributing the power of the capacitor 3 is performed.

The CPU 46 judges a case where the elapsed time T since the power is turned off is shorter than 30 minutes as a short-term power-off such as a jam. Then, when the power is turned on again, the whole (100%) power of the capacitor 3 is distributed to the fixing device.

Figure 8:
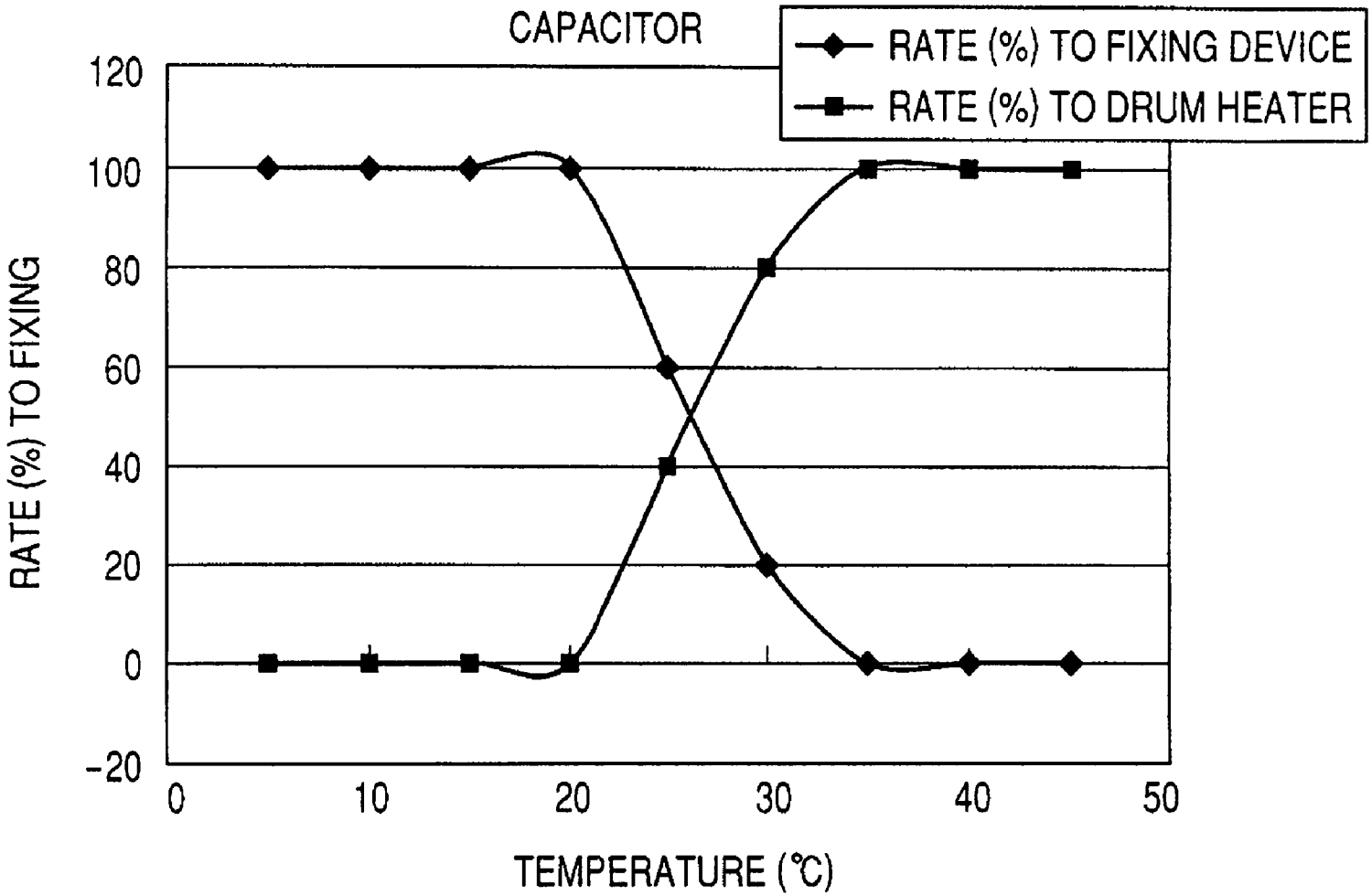
FIG. 8 is an explanatory diagram (environmental table) of a distribution of the capacitor power to the fixing device and the drum heater.

In a case where 30 minutes or more have passed, the CPU 46 detects the temperature of the environmental sensor A at the point of time, and the rate of power activation is determined on the basis of the temperature from the environmental table, based on a curve showing the rate of the power activation of the capacitor power to the fixing device 26 and the drum heater 36 as schematically shown in FIG. 8, thereby distributing the power.

In FIG. 8, an abscissa axis shows environmental temperature detected by the environmental sensor A and an ordinate axis shows a power distribution factor to the fixing device 26. When the environmental temperature is from 20° C. to 35° C., power distribution is performed on the drum heater with more importance than on fixing. Thus, optimized power distribution can be attained.

With the structure described above, power is further effectively used, thereby making it possible to provide an image forming apparatus in which a cost of the capacitor 3 is suppressed, a defect of images due to the image deletion on the photosensitive drum or the like is prevented, and the warming-up time of the fixing device 26 is shortened.

In this embodiment, only the temperature detected by the environmental sensor A is used, but by using an absolute moisture amount or a humidity detected by the environmental sensor A, or combined information of the temperature, absolute moisture amount and the humidity, a control of the rate of power activation of the capacitor power to the fixing device 26 and the drum heater 36 may be executed.

The control for changing the rate of power activation of the capacitor power to the fixing device 26 and the drum heater 36 can also be executed when the image forming apparatus is in a state of power-on and is returned from the low-power mode based on the image forming start signal in a standby state at a low-power mode. In addition, when the image forming apparatus is returned from the standby state to a state in which image forming is possible, the control of changing the rate of the power activation to the fixing roller 26 and the drum heater 36 can also be controlled according to the stand-by time.

Third Embodiment

In this embodiment, the capacitor power can be distributed to a cassette heater (not shown) and an optical system dew condensation preventing heater (not shown) in addition to the drum heater 36 and the fixing device 26 of the first and second embodiments. The cassette heater is a heating means for stabilizing a moisture amount and temperature of the recording material, and is disposed in a recording material containing cassette serving as an image forming member involved in the formation of an image on a recording material. The optical system dew condensation preventing heater is a heating means disposed in the exposure means 22 serving as an image forming member involved in the formation of the image on the recording material.

Thus, a normal power consumption can be further reduced. When the cassette heater is used, the CPU 46 detects a deviation from a room temperature of 23° C. and operates the cassette heater when the deviation is detected. In this embodiment, the cassette heater is operated in a case where the temperature is equal to or lower than 18° C., or is equal to or higher than 25° C., and the power supply amount from the capacitor 3 is set to 40 W.

The optical system dew condensation preventing heater is allowed to be operated only at low temperature. In this embodiment, the optical system dew condensation preventing heater is operated at temperature equal to or lower than 15° C. An allocated power supply amount from the capacitor 3 is constantly set to 30 W.

The supply rate of the capacitor power to the drum heater 36 and the fixing device 26 is the same as that of the second embodiment. Based on the environmental table shown in FIG. 8, the power amount, in which necessary power is subtracted from the whole electric energy of the capacitor 3 in a state where the temperature condition is satisfied, is allocated to the fixing device 26 and the drum heater 36.

With the structure described above, power is effectively used, thereby making it possible to provide an image forming apparatus in which the warming-up time for the fixing device 26 of the capacitor 3 is shortened.

In this embodiment, only the temperature detected by the environmental sensor A is used, but by using the absolute moisture amount or the humidity detected by the environmental sensor A, or combined information of the temperature, absolute moisture amount or the humidity, a control for changing the rate of power activation of the capacitor power to the fixing device 26 and the drum heater 36 may be controlled.

The control for changing the rate of power activation of the capacitor power to the fixing device 26 and the drum heater 36 can also be executed when the image forming apparatus is in a state of power-on and is returned from the low-power mode based on the image forming start signal in a standby state at a low-power mode. In addition, when the image forming apparatus is returned from the standby state to a state in which image forming is possible, the control of changing the rate of the power activation to the fixing roller 26 and the drum heater 36 can also be controlled according to the stand-by time.

This application claims priority from Japanese Patent Application No. 2005-136281 filed May 9, 2005, which is hereby incorporated by reference herein.

What is claimed is:

1. An image forming apparatus comprising:

an image forming portion including an image bearing member for bearing an electrostatic image and an developing device for developing the electrostatic image on said image bearing member, for forming a toner image to a recording material;

a heater, which heats said image bearing member;

a heating fixing device, which heat-fixes the toner image on the recording material;

a capacitor, which stores an electricity supplied from a commercial power source;

a distributor, which distributes power of said capacitor to said heat fixing device and said heater in a warming-up time for increasing a temperature of said heat fixing device to a predetermined temperature; and control means for controlling said distributor to make a distribution rate of the power of said capacitor to said heat fixing device larger than a distribution rate of the power of said capacitor to said heater when an atmospheric temperature is lower than a predetermined temperature, and to make the distribution rate of the power of said capacitor to said heater larger than the distribution rate of the power of said capacitor to said heat fixing device when the atmospheric temperature is higher than or equal to the predetermined temperature.

2. An image forming apparatus comprising:

an image forming portion for forming a toner image to a recording material;

a heater, which heats said image forming portion;

a heat fixing device, which heat-fixes the toner image on the recording material;

a capacitor, which stores an electricity supplied from a commercial power source;

a distributor, which distributes power of said capacitor to said heat fixing device and said heater; and changing means for changing, in accordance with a time for which said image forming apparatus was in a standby state, a rate of a power distributed from said capacitor to said heat fixing device to a rate of power distributed from said capacitor to said heater when said image forming apparatus is returned from said standby state to a state in which an image formation is possible.

3. An image forming apparatus according to claim 2, wherein said image forming portion comprises an image bearing member for bearing an electrostatic image and a developing device for developing the electrostatic image on said image bearing member, and said heater heats said image bearing member.

* * * * *